United States Patent [19]

Hofer

[11] Patent Number: 4,843,628

[45] Date of Patent: Jun. 27, 1989

[54] INERTIAL MICROPHONE/RECEIVER WITH EXTENDED FREQUENCY RESPONSE

[75] Inventor: Alan Hofer, Wantagh, N.Y.

[73] Assignee: Stanton Magnetics, Inc., Plainview, N.Y.

[21] Appl. No.: 883,985

[22] Filed: Jul. 10, 1986

[51] Int. Cl.[4] ..... H04R 11/00; H04R 9/02; H04R 1/28

[52] U.S. Cl. ..... 381/200; 381/151; 381/159; 381/190; 381/193; 381/194; 381/199; 381/203

[58] Field of Search ..... 381/192, 193, 194, 199, 381/200, 202, 203, 150, 151, 152, 159, 187, 177; 181/160

[56] References Cited

U.S. PATENT DOCUMENTS

| | | | |
|---|---|---|---|
| 2,252,846 | 8/1941 | Giannini et al. | 381/199 |
| 2,255,249 | 9/1941 | Greibach | 381/177 |
| 2,255,250 | 9/1941 | Greibach | 381/177 |
| 2,778,882 | 1/1957 | Pontzen et al. | 381/177 |
| 3,014,099 | 12/1961 | Fiala | 381/177 |
| 3,134,861 | 5/1964 | Dempsey | 381/151 |
| 3,418,437 | 12/1968 | Hoffmann | 181/160 |
| 3,723,670 | 3/1973 | Sebesta et al. | 379/430 |
| 3,733,445 | 5/1973 | Sebesta et al. | 381/200 |
| 4,000,381 | 12/1976 | Plice ert al. | 381/199 |
| 4,006,318 | 2/1977 | Sebesta et al. | 381/151 |
| 4,063,049 | 12/1977 | Pipitone et al. | 381/159 |
| 4,272,654 | 6/1981 | Carlson | 381/200 |
| 4,591,668 | 5/1986 | Iwata | 381/151 |

FOREIGN PATENT DOCUMENTS

| | | | |
|---|---|---|---|
| 88154 | 9/1983 | European Pat. Off. | 381/68 |
| 1167897 | 4/1964 | Fed. Rep. of Germany | 381/158 |
| 2246981 | 4/1974 | Fed. Rep. of Germany | 381/158 |
| 2831326 | 1/1980 | Fed. Rep. of Germany | 381/150 |
| 2831401 | 1/1980 | Fed. Rep. of Germany | 381/159 |
| 60-142699 | 7/1985 | Japan | 381/159 |
| 305690 | 7/1971 | U.S.S.R. | 181/160 |
| 1173623 | 12/1969 | United Kingdom | 381/177 |

OTHER PUBLICATIONS

L. G. Pacent and E. H. Greibach, *AIEE Technical Paper*, "Inertial Throat Microphone", Dec. 1945, pp. 1–10.

*Primary Examiner*—Jin F. Ng
*Assistant Examiner*—Danita R. Byrd
*Attorney, Agent, or Firm*—Kane, Dalsimer, Sullivan, Kurucz, Levy, Eisele and Richard

[57] ABSTRACT

An inertial transducer is provided comprising a housing containing therein a magnetic circuit including components thereof separated by a spring diaphragm wherein the flexing of the diaphragm causes the components to move toward and away from each other to induce a current in a coil. The spring diaphragm served to separate the housing into two tuned cavities, the frequencies of which differ from each other and from that of the spring diaphragm. The transducer has frequency response peaks at the resonant frequencies of the cavities and spring diaphragm.

7 Claims, 2 Drawing Sheets

INERTIAL MICROPHONE/RECEIVER WITH EXTENDED FREQUENCY RESPONSE

BACKGROUND OF THE INVENTION

The present invention relates to sound transducers and in particular to an inertial microphone/receiver device.

In the conventional microphone air, disturbed by soundwaves, serves to move a diaphragm which in turn serves to disturb an electro-magnetic field to thereby generate an electrical signal. In the conventional receiver the reverse occurs. That is, an electric current serves to disturb an electro-magnetic field to in turn drive a diaphragm to generate sound waves. While such transducers have many benefits including excellent frequency response, their principal shortcoming is that they can only be used in an environment where air is available as a driving (or driven) medium. Another shortcoming is that they cannot readily differentiate between sources of moving air and hence, particularly as a microphone, they are extremely noise sensitive. As a result they cannot readily be utilized in certain extreme environments, such as where there is a high level of ambient noise (e.g. near motorcycles, heavy equipment, etc.) or where for one reason or another a speaker's mouth is masked (e.g. surgical theaters, fire fighters with gas masks, etc.).

To overcome the shortcomings of the conventional air driven transducer it has heretofore been suggested to utilize inertial transducers. In an inertial microphone the vibrations of a sound source are applied to a relatively low mass connected to a relatively large mass through a spring diaphragm. The movement of the low mass with respect to the large mass causes the spring diaphragm to oscillate within an electro-magnetic field thereby generating an electric signal. In operation as a speaker the electric signal is used to vary an electro-magnetic field to thereby drive a spring diaphragm connecting a large mass to a small mass thereby causing the one mass to oscillate with respect to the other to produce sound waves. Since such transducers need not rely on air movement they can be utilized in bone conduction microphones and receivers.

Heretofore the principal problem of inertial transducers has been that they are extremely frequency limited and hence produce an unnatural sound particularly when used for voice communication. The reason for this is that the spring diaphragm is basically a single frequency device so that all signals tend to peak at the natural frequency of the spring. This produces an extremely degraded and distorted signal for voice communication.

In view of the above, it is the principal object of the present invention to provide an improved inertial transducer having a relatively flat response over a relatively wide frequency range.

Another object is to provide such a transducer in which the range in which the frequency response is generally flat corresponds with the principal frequencies of voice communication.

Still another object is to provide such a transducer in a size and shape that may readily be adapted for a microphone or ear speaker.

A further object is to provide such a transducer in a form that is realtively simple and economic to assemble.

Still other objects and advantages will be apparent from the following description of the invention.

SUMMARY OF THE INVENTION

The above and other beneficial objects and advantages are attained in accordance with the present invention by providing an inertial microphone in which a spring diaphragm acts both as a spring connecting a large mass to a small mass and also as a diaphram on a common wall between two chambers. As the spring diaphragm moves (in response to vibrations) an electric signal is generated as a result of relative movement between a coil and a magnetic field. Alternatively, as a signal is applied to the coil the spring diaphragm is caused to move to set up vibrations. The spring and two chambers are each tuned to different frequencies within the desired frequency range thereby setting up three frequency peaks and a relatively flat response between the peaks.

DETAILED DESCRIPTION OF THE PREFERRED EMBODIMENT

Figure 1:
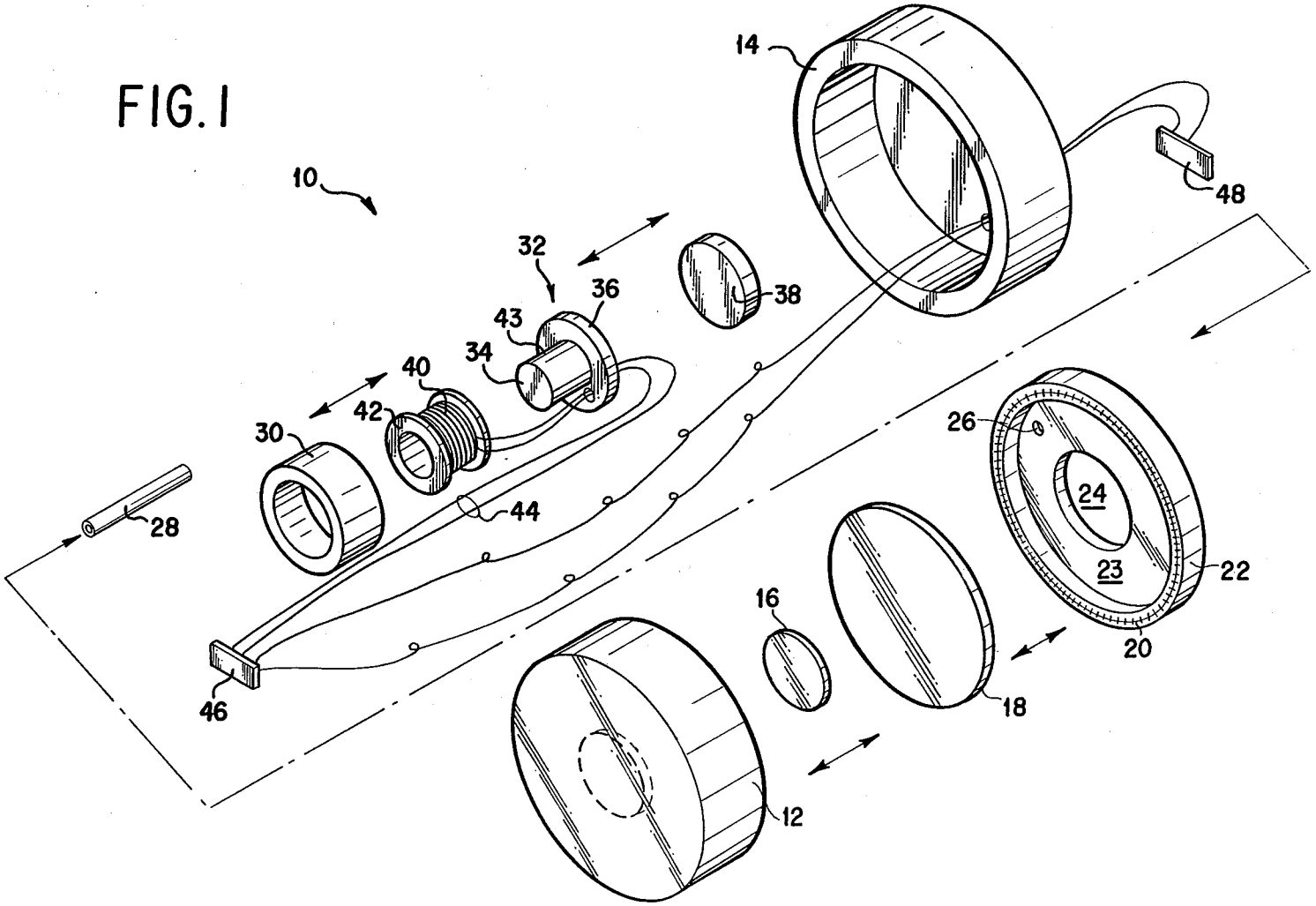
FIG. 1 is an exploded perspective view of a transducer in accordance with the present invention; and, FIG. 2 is an elevational sectional view of the assembled transducer.
Figure 2:
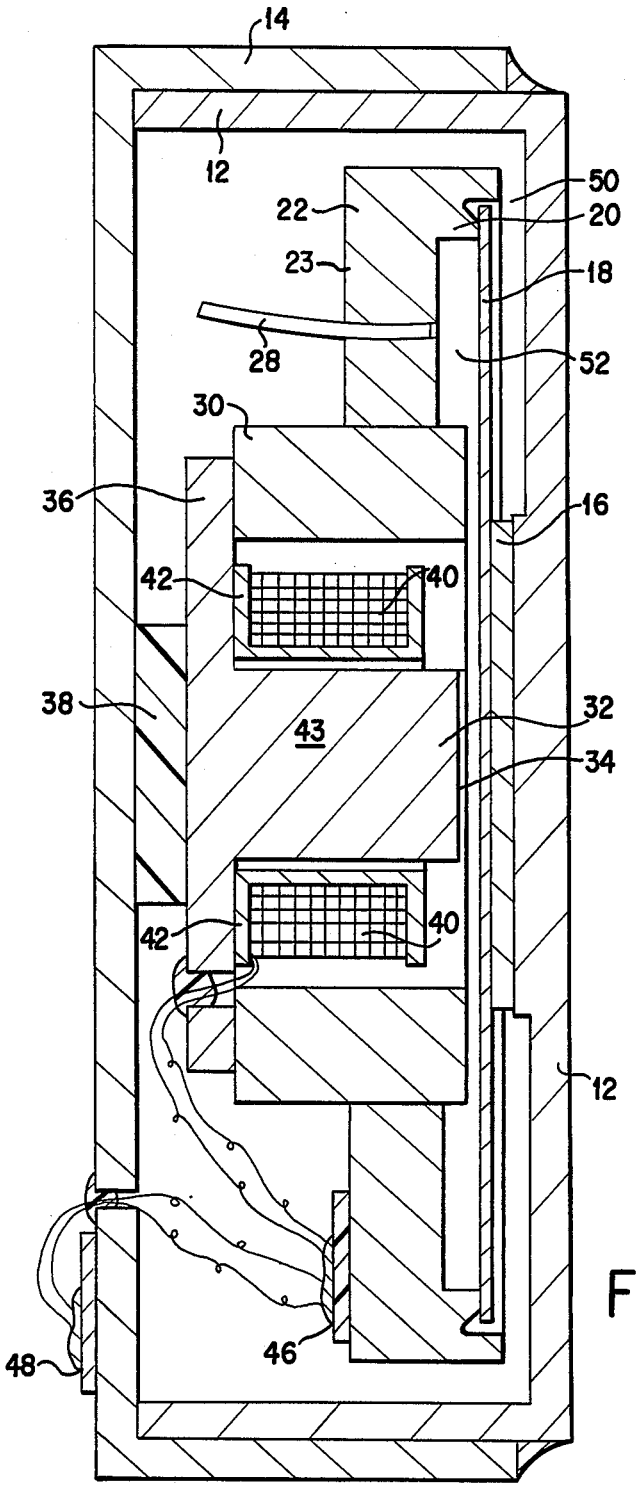

Reference is now made to the drawings and to FIG. 1 in particular wherein the transducer 10 of the present invention is shown as comprising an inner housing 12 and outer housing 14. Both housings 12,14 comprise tubular cylinders having an open end and a closed end. The inner housing 12 is sized to closely fit within the outer housing 14 and is sealed in position as shown in FIG. 2.

The transducer 10 further includes an armature 16 in the form of a disc of a magnetic material bonded by epoxy or the like to the interior of the closed end of the inner housing. The armature 16 is spot welded to a spring diaphragm 18 which in turn sits on a knife edge 20 which extends from the base 23 of a brass ring 22. Ring 22 has a central opening 24 extending through the base and an off-centered, much smaller opening 26. Opening 26 is sized to receive a Thuras tube 28 which extends toward the closed end of outer housing 14. A ring magnet 30 extends through the central opening 24. Magnet 30 is magnetized so that one pole is directed toward the closed end of housing 12 and the other pole is directed toward the closed end of housing 14.

A magnetic pole piece 32 concentric with the ring magnet 30 also extends through opening 24. One end 34 of pole piece 32 terminates flush to the corresponding pole of magnet 30. The other end of pole piece 32 terminates in a circular flange 36 one side of which rests against the corresponding pole of magnet 30. The opposite side of flange 36 rests on a damper pad 38, formed of rubber or the like, which in turn rests against the closed end of outer housing 14.

A coil 40 is wound about a bobbin 42 which in turn is positioned about the central post 43 of pole piece 32. The leads 44 of coil 40 are brought to a terminal board 46 mounted to ring 22 and from there through a sealed opening in outer housing 14 to an exterior terminal board 48 mounted to the exterior of housing 14.

As can be seen in FIG. 2, non-perforated spring diaphragm 18 forms a common wall between a first chamber 50 that is generally defined by the volume within the assembled housing surrounding brass ring 22, and a second chamber 52 that comprises the volume between the diaphragm and brass ring as well as that of the Thuras tube 28.

In operation as a microphone, the assembled transducer is positioned against a source vibrating in response to sounds being generated, for example, the transducer may be placed against the head of a speaker behind the ear. As a result of the vibrations imparted to the transducer, the ring 22, magnet 30, and pole piece 32 desire to remain stationary due to the inertia of their mass while the housings 12 and 14 and the armature 16 are driven causing deflections in spring diaphragm 18 thereby changing the gap between pole 32 and armature 16 and thus altering the lines of flux cut by coil 40. The current induced in coil 40 may then be picked up at the terminal board 48.

In operation as a receiver a signal is applied to coil 40 thereby altering the magnetic circuit and causing the coil 40, pole 43, and magnet 30 to move toward or away from the pole piece 32. Due to the inertia of their mass, the movement is transferred to the housings 12, 14 and armature 16 through the action of spring 18. The movement may be detected directly (such as by placing the receiver against the skull of a listener) or indirectly by placing the transducer against a sounding board to generate sound waves.

By properly sizing the components the cavities of the first and second chambers 50,52 can be tuned. Similarly the resonant frequency of the diaphragm may be tuned by proper selection of the diaphragm material. In a preferred practice of the invention, the resonant frequency of chamber 50 was 1500 Hz; the resonant frequency of chamber 52 was 600 Hz; and the spring resonance was 2500 Hz. Since the two tuned cavities and spring have relatively low q values, the frequency response between the 600 Hz, 1500 Hz and 2500 Hz peaks tends to flatten out thereby providing a relatively flat frequency response in the voice communication range. The inertial transducer is inherently noice cancelling since both sides of the transducer housing 12, 14 are moving in phase to one another and ambient noise is cancelled as a result.

Thus in accordance with the above the aforementioned objectives are effectively attained.

Having thus described the invention, what is claimed is:

1. In an inertial transducer of the type comprising a housing; a non-perforated spring-diaphragm mounted within said housing; a magnetic circuit within said housing including an armature mounted to said housing and one side of said diaphragm, and a pole piece on the opposite side of said diaphragm; and a coil extending about said pole piece; wherein relative movement of said pole piece toward said armature causes a current to be induced in said coil the improvement comprising a first tuned cavity defined on one side of said diaphragm, a second tuned cavity defined on the opposite side of said diaphragm and means interconnecting the first and second tuned cavities wherein said first and second cavities are tuned to frequencies within the acoustic band which are different from each other and different from the resonant frequency of said spring diaphragm.

2. The inertial transducer in accordance with claim 1 wherein said interconnecting means comprises a Thuras tube.

3. The inertial transducer in accordance with claim 1 wherein said first and second cavities are tuned to frequencies of approximately 600 Hz and 1500 Hz respectively and the resonant frequency of said spring-diaphragm is approximately 2500 Hz.

4. The inertial transducer in accordance with claim 1 further comprising a ring having a base with a central opening therein mounted within said housing, a knife edge extending from said base about said opening, said spring diaphragm being supported on said knife edge; and said pole piece extending through said central opening wherein said first tuned cavity comprises the volume generally between said diaphragm and said ring base and said second tuned cavity comprises the volume of said housing surrounding said diaphragm and said ring.

5. The inertial transducer in accordance with claim 4 wherein said interconnecting means comprises a Thuras tube extending through an opening in said base off-centered from said central opening.

6. The inertial microphone in accordance with claim 4 wherein said first and second cavities are tuned to frequencies different from each other and different from the resonant frequency of said spring diaphragm.

7. The inertial transducer in accordance with claim 6 wherein said first and second cavities are tuned to frequencies of approximately 600 Hz and 1500 Hz respectively and said spring diaphragm has a resonant frequency of approximately 2500 Hz.

* * * * *